US005219426A

United States Patent [19]

Ehrlich

[11] Patent Number: 5,219,426

[45] Date of Patent: Jun. 15, 1993

[54] SINGLE-ELEMENT CODED ALTERNATING CURRENT RAILWAY TRACK CIRCUIT HAVING DOUBLE-ELEMENT, PHASE-SELECTIVE CAPABILITY

[75] Inventor: Anthony G. Ehrlich, Pittsburgh, Pa.

[73] Assignee: Union Switch & Signal Inc., Pittsburgh, Pa.

[21] Appl. No.: 841,387

[22] Filed: Feb. 25, 1992

[51] Int. Cl.[5] ..... B61L 1/18; B61L 23/16

[52] U.S. Cl. ..... 246/34 R; 246/34 B

[58] Field of Search ..... 246/33 R, 34 R, 34 B, 246/34 C, 34 CT, 41, 121, 122 R, 130, 131

[56] References Cited

U.S. PATENT DOCUMENTS

| | | | |
|---|---|---|---|
| 2,360,948 | 10/1944 | Jerome | 246/33 R X |
| 2,884,516 | 1/1959 | Staples | 246/34 R |
| 3,046,454 | 7/1962 | Staples | 246/41 X |
| 3,246,141 | 12/1961 | Ehrlich | 246/34 R |
| 3,428,868 | 2/1969 | Duckitt et al. | 246/41 X |
| 3,781,540 | 12/1973 | Staples | 246/34 CT |
| 3,927,851 | 12/1975 | Wilcox | 246/34 R X |
| 3,986,691 | 10/1976 | Ehrlich et al. | 246/34 R |
| 4,181,278 | 1/1980 | Pascoe | 246/34 R |
| 4,188,002 | 2/1980 | Gilcher | 246/34 R |
| 4,298,179 | 11/1981 | Gilcher | 246/34 R |
| 4,314,306 | 2/1982 | Darrow | 246/34 CT X |
| 4,392,626 | 7/1983 | Pascoe | 246/34 CT X |

OTHER PUBLICATIONS

B. Mishelevich, "Coded Track Circuits and Cab Signaling", *The Signalmans Journal*, May-Sep. 1950, pp. 10-12.

*Primary Examiner*—Michael S. Huppert
*Assistant Examiner*—Scott L. Lowe
*Attorney, Agent, or Firm*—Buchanan Ingersoll

[57] ABSTRACT

The invention provides a single-element coded alternating current railway track circuit which may be adapted to a double-element Phase-Selective configuration. A transmitter, via a transmitter transformer, provides a coded track signal to the track. A receiver transformer having one primary winding and a pair of secondary windings receives the track signal. One of the secondary windings is connected directly across a rectifier. The other secondary winding is connected in series with a secondary winding of a local transformer. This serial combination is electrically connected across another rectifier. A DC code-following relay is electrically connected across a rectified output of the first rectifier via two output terminals. A third output terminal allows substitution of a magnetic stick relay for the code-following relay if a double-element configuration is desired. The primary winding of the local transformer has terminals for connecting an AC source when using the optional double-element configuration.

4 Claims, 3 Drawing Sheets

SINGLE-ELEMENT CODED ALTERNATING CURRENT RAILWAY TRACK CIRCUIT HAVING DOUBLE-ELEMENT, PHASE-SELECTIVE CAPABILITY

BACKGROUND OF THE INVENTION

1. Field of the Invention

This invention relates generally to the art of railway track circuits. More particularly, the invention relates to a single-element coded AC railway track circuit which is easily adaptable to a double-element, phase-selective configuration. A single-element track circuit uses a receiver requiring only one input signal which is transmitted to it via the track from a distant source. A double-element track circuit uses a receiver requiring such a signal plus an additional input signal which is supplied locally—i.e., at the receiver location.

2. Description of the Prior Art

A railway is a mode of transportation necessarily limited to "one degree of freedom." That is to say, a railway vehicle can only travel back and forth along a track. It cannot alter its path to avoid other traffic. In order to prevent vehicles on the same track from overtaking one another, a block signalling scheme has been devised whereby the track is divided into segments, or "blocks," of a length greater than the stopping distance of a train. Normally, only one train is allowed in a particular block at a time. Typically, wayside indicators placed before an upcoming block indicate to the locomotive operator whether or not an upcoming block is occupied. If so, the operator will know to adjust the speed of his train to avoid a problem.

Railway signalling has been traditionally controlled by the track circuit. The track circuit is essentially an electrical circuit in which the rails within a block provide electrical connection between an electrical signal transmitter and an electrical signal receiver. Electrical separation between adjacent blocks may be provided by insulating joints. The transmitter impresses an electrical signal into the rails at the transmit end of the block which may be received by the receiver at the opposite end if the block is unoccupied and no state of broken rail exists. The receiver, such as a relay, can then operate to display an appropriate aspect on the wayside indicator.

The original track circuits operated only on direct current. It was soon discovered, however, that alternating current track circuits were less susceptible to stray direct currents which could enter the system, for example, through the ground. One early AC track circuit was known as the "Universal Code" track circuit. This single-element circuit operated on a coded AC track signal using a resonant unit tuned to the AC frequency. The track signal was then rectified to operate a code-following DC relay. The "Universal Code" track circuit, however, had one notable disadvantage. Specifically, AC track circuits using insulating joints to provide electrical separation between blocks are inherently more likely than DC track circuits to disrupt operation of wayside indicators in adjacent blocks if the insulating joints break down. This is because AC relays cannot discriminate between polarities as some DC relays can. Staggered rail polarities in adjacent blocks can be used to provide broken down joint protection with DC track circuits, but not with AC track circuits having polarity-insensitive AC relays.

The problem of insulated joint breakdown is especially acute in electric-train territory, also called electrified railway territory, where the two rails also carry propulsion return currents. Here, adjacent blocks are connected by impedance bonds which, by autotransformer action, can allow the full track signal voltage at the transmit end of an adjoining block to feed across a single defective joint into the receiver end of the other block. The Universal Code track circuit employed a complicated "non-vital" lock-out circuit for broken down joint protection. The term "non-vital" signifies that it was theoretically possible for the lock-out circuit to fail in such a way that an unoccupied indication could be given for an occupied block under broken down joint conditions.

In order to combat this shortcoming, a double-element Phase-Selective Track Circuit was developed. With this coded track circuit, adjacent blocks are fed by a common AC energy source, but with the rails having opposite relative polarity. A Phase-Selective Unit placed between the rails and the receiver relay receives a local input from the same AC source. The Phase Selective Unit contains circuitry which distinguishes the desired track signal from that of adjacent blocks based on their phase relationship with respect to the local input. The Phase-Selective Unit operates the receiver relay only when a track signal of the proper polarity compared to the local signal is received. Thus, if an insulating joint separating the blocks breaks down and current from an adjacent block enters the Phase-Selective Unit, this current will be ineffective to operate the relay. For phase referencing, the same AC energy source is required to supply both the track signal and the local signal; therefore, a feed voltage line running the entire length of the respective track circuit is required.

Block lengths in such double-element track circuits may typically be up to 6,000 feet or more. Further, many track circuits can be cascaded. Thus, the additional cost of the source line can be significant. Also, in some locations the theft of copper wire has been a problem which has caused frequent track circuit outages, as well as expensive repairs.

SUMMARY OF THE INVENTION

The invention provides a single-element coded AC railway track circuit which may be easily adapted to a double-element phase-elective configuration depending on the exigencies of a particular application. The track circuit of the invention has a transmitter including source means for providing an alternating current energy to a transmitter transformer. A track signal is generated by a coding means electrically connected intermediate the source means and a primary winding of the transformer. A series impedance is also electrically connected between the source means and the primary winding of the transmitter transformer. A secondary winding of the transmitter transformer is connected across the rails within a block.

The track circuit of the invention further includes a receiver having a transformer with one primary winding and a pair of secondary windings. The primary winding is connected to receive the track signal from the rails at the second, opposite end of the block. This may be accomplished by connecting the primary winding directly across the rails. Alternatively, the primary winding may be inductively coupled to the rails via an interposing transformer. One of the secondary windings of the receiver transformer is connected directly across a rectifier. The other secondary winding of the receiver transformer is connected in series with the secondary winding of a phase reference transformer, also called a local transformer. This serial combination is electrically connected across another rectifier. A DC code-following relay is electrically connected across a rectified output of the first rectifier. The primary winding of the local transformer has terminals thereon for connecting an AC source.

DETAILED DESCRIPTION OF PRESENTLY PREFERRED EMBODIMENTS

In some applications, it is desirable to provide a single-element railway track circuit. This eliminates the cost attributable to line wire of double-element Phase-Selective Track Circuits which can be considerable. Also, track circuit outages and replacement expense caused by theft of line wire is not a problem with single-element track circuits. The present invention provides a single-element track circuit which is also capable of Phase-Selectiveness with minor modification. Additionally, broken down joint protection is provided by vital components.

Figure 1:
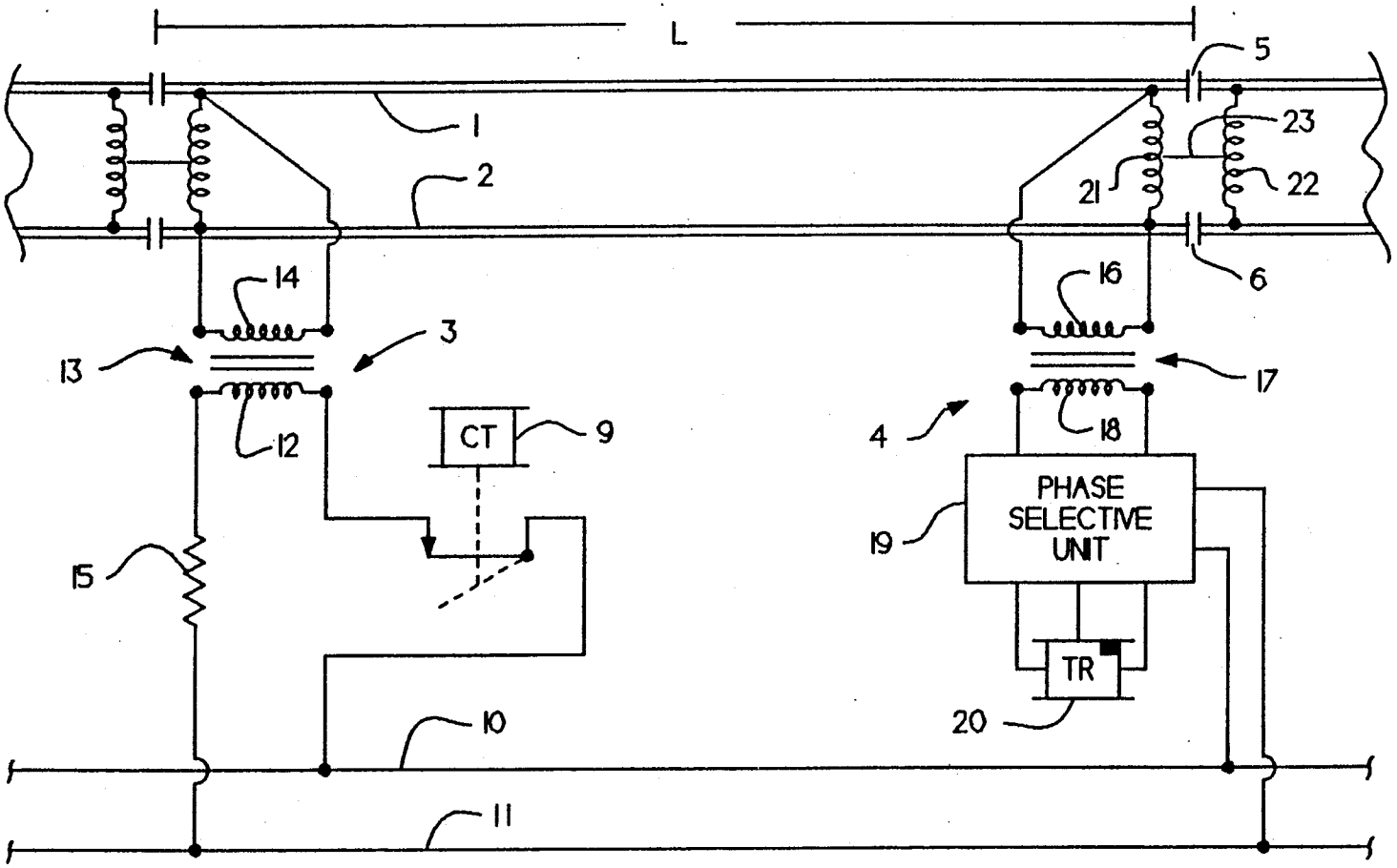
Fig.1. (Prior Art)
FIG. 1 is a diagramatic illustration of a prior art double-element track circuit utilizing a Phase-Selective Unit.

FIG. 1 illustrates a prior art double-element Phase-Selective Track Circuit. Rails 1 and 2 are used to transmit a track signal from transmitter end 3 to receiver end 4. If the block L is unoccupied and no state of broken rail exists, the track signal will be received at receiver end 4. If, however, a railway vehicle is present within the block, shunt paths are created by the presence of wheel and axle sets. Thus, track signal is prevented from reaching receiver end 4. Circuitry at receiver end 4 will operate aspect lights or other indications permitting a train approaching the block to properly recognize the block as occupied or unoccupied. Insulating joints, such as 5 and 6, or other means are provided to electrically separate rails in block L from rails in adjacent blocks.

Transmitter relay 9 selectively operates to provide electrical connection from alternating current power lines 10 and 11 (typically 12 volts, 10 Hertz) to primary winding 12 of transmitter transformer 13. This provides track signal coding to secondary winding 14 which is connected across rails 1 and 2. Resistor 15 represents any impedance which it is desirable to place serially with the transmitter.

If the block is unoccupied and no state of broken rail exists, the coded track signal is received at primary winding 16 of interposing transformer 17. Secondary winding 18 of transformer 17 is electrically connected to Phase-Selective Unit 19 which contains circuitry to operate track relay 20. Track relay 20 is a single pole-double throw magnetic stick relay.

To provide a return path for the propulsion return current in electrified territory while maintaining electrical separation of adjacent blocks for purposes of the coded track signal, impedance bonds are utilized. Typically, the impedance bonds will comprise center tapped inductances such as 21 and 22 conductively interconnected by a return path conductor such as 23. This interconnection of blocks can aggravate problems associated with the breakdown of insulated joints. In this track circuit, however, circuitry within Phase-Selective Unit 19 prevents undesirable activation of track relay 20 by currents flowing across the insulated joints.

Phase-Selective Unit 19, which is available as a commercial unit within a common housing, essentially operates by responding to give a clear aspect only when receiving an AC track signal which is properly phased with respect to that provided by power lines 10 and 11 via a local transformer inside unit 19. To provide this input, power lines 10 and 11, which typically run alongside rails 1 and 2 on poles, can be connected to appropriate connectors or terminals on Phase-Selective Unit 19.

Figure 2:
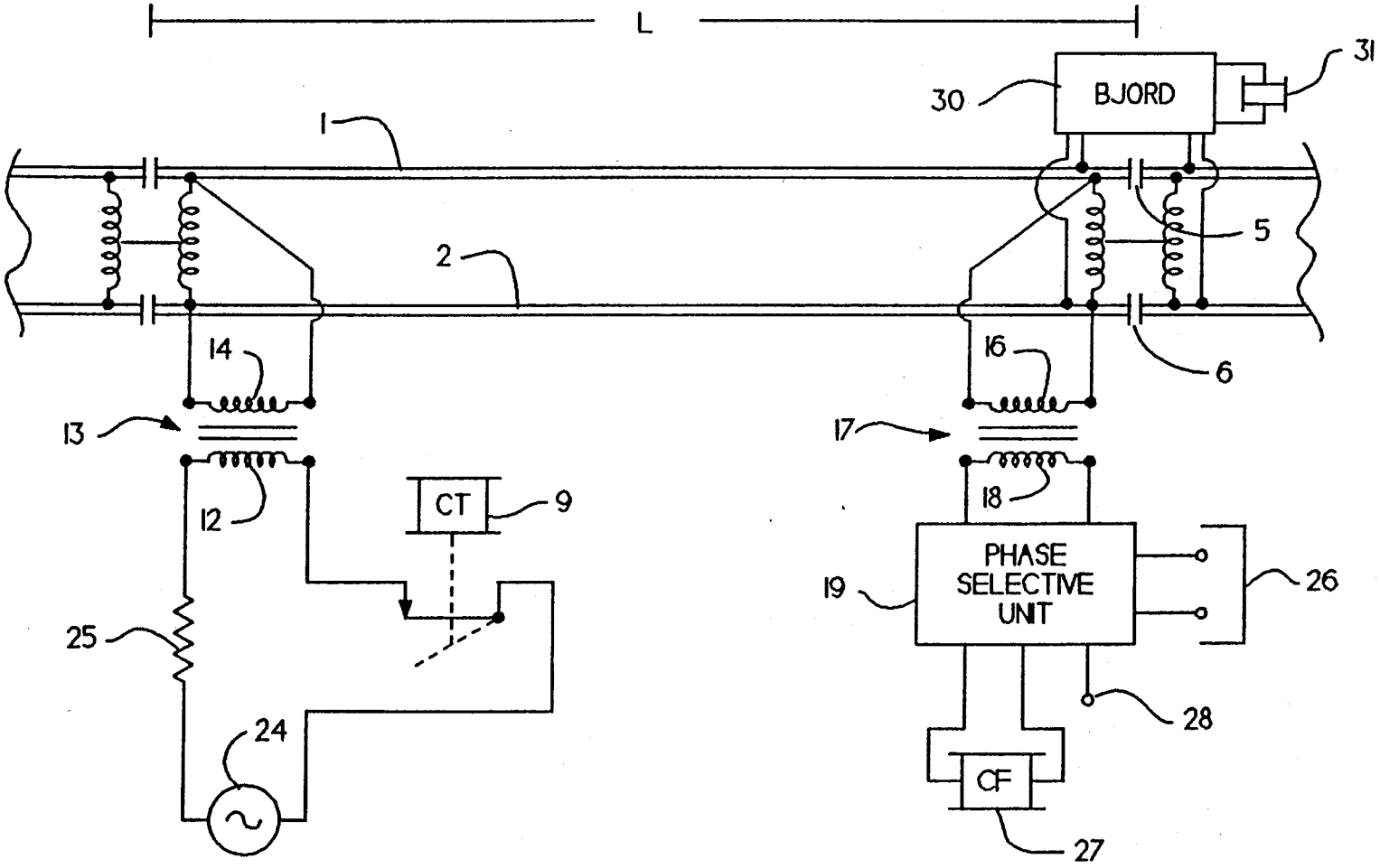
FIG. 2 is a diagramatic illustration of a presently preferred embodiment of a single-element coded AC track circuit constructed in accordance with the invention.

FIG. 2 illustrates a single-element track circuit constructed in accordance with the invention. The invention allows the elimination of line wire in areas where the use of such wire is impractical, but retains easy adaptability to double-element phase-selective use. Connection between primary winding 12 of transformer 13 and an alternating current energy source means, such as AC source 24, is selectively provided by coding means such as transmitter relay 9. Source 2 may comprise any appropriate source of alternating current energy, such as an electronic frequency converter or a motor-generator set. Relay 9 thus establishes a traffic signal code in secondary winding 14 of transmitter transformer 13. If block L is unoccupied, this track signal is conducted through primary winding 16 of interposing transformer 17. Series impedance 25 is chosen to limit source current when block L is occupied and also to ensure proper phasing between the track and local signals in the event that double-element operation is desired. Secondary winding 18 of interposing transformer 17 then provides an input signal to Phase-Selective Unit 19 as before. It is to be understood that while the use of an interposing transformer s generally desirable, it is not necessary to the invention.

Unlike the double-element track circuit in FIG. 1, the track circuit of the invention operates without a local input from an AC source. Thus, the line wire input terminals indicated at reference 26 are unconnected. Further, instead of magnetic stick track relay 20, the invention contemplates the use of a code-following DC relay 27. Relay 27 is a single pole-single throw type which actuates against the force of gravity. This relay requires only two connections—one live and one common. Thus, track relay reverse position input 28 remains unconnected. In this manner, the invention allows use of preexisting track circuit equipment in a novel manner to eliminate feed wire.

The defective joint protection provided by the double-element track circuit can be provided with the invention using a vital broken down joint and overrun detector, such as detector 30. Detector 30 is connected to the rails across insulating joints 5 and 6, respectively. Detector 30 contains circuitry which determines whether the associated joints are providing effective electrical separation. If a joint has broken down and is not providing such separation, a detector relay, such as relay 31 is activated. Relay 31 can deactivate the transmitter in the adjoining block. This prevents code-following relay 27 from being inadvertently activated if a joint fails. A presently preferred detector for use with the invention is currently marketed by Union Switch & Signal, Incorporated having the model designation BJORD-10 ("BJORD" is an acronym for "broken down joint and overrun detector"). This BJORD is disclosed in Robert D. Pascoe U.S. Pat. No. 4,181,278 issued on Jan. 1, 1980, incorporated herein by reference. Normally, a BJORD would be used at the transmitter end of the track circuit as well as the receiver end in order to also check the insulated joints there.

Figure 3:
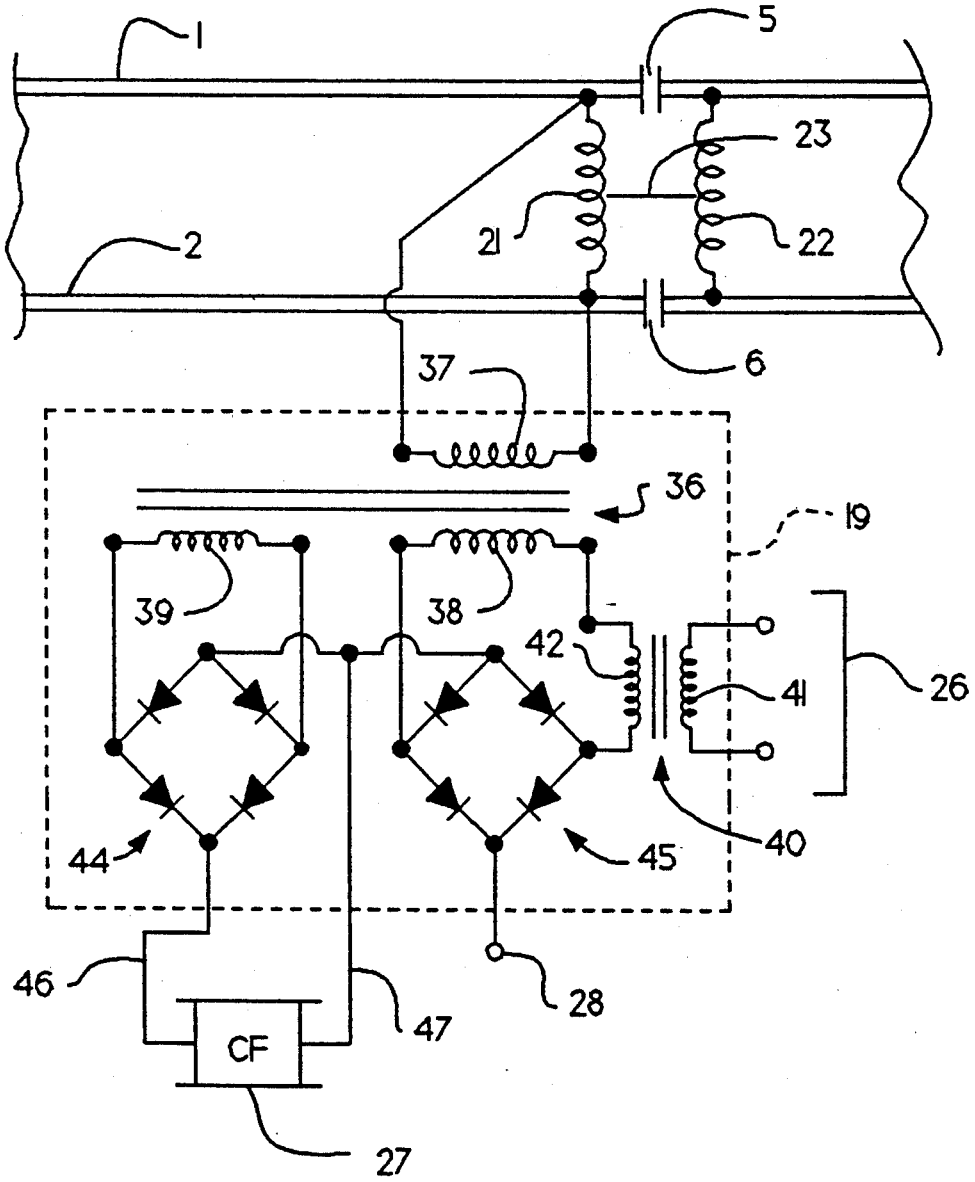
FIG. 3 is a partial diagramatic view schematically illustrating the means of the invention for providing double-element Phase-Selective capability.

FIG. 3 schematically illustrates the circuitry contained within Phase-Selective Unit 19 as connected according to the invention. For the sake of simplicity, interposing transformer 17 has been removed from the drawing. Phase Selective Unit 19 has a first transformer 36 therein having a primary winding 37 connected to receive track code signals from rails 1 and 2. Additionally, transformer 36 has a pair of secondary windings 38 and 39. A phase reference or local transformer 40 has a primary winding 41 for receiving a local input if the circuit is expanded to a double-element Phase-Selective configuration. A secondary winding 42 is connected serially to secondary winding 38 such that windings 38 and 42 have opposite relative polarities. A rectifier 44 is electrically connected across secondary winding 39. Similarly, a rectifier 45 is electrically connected across the serial combination of secondary windings 38 and 42. Preferably, rectifiers 44 and 45 are full wave bridge rectifiers as shown. Relay 27 is connected across a rectifying output of rectifier 44 comprising DC output lead 46 and common lead 47. Track relay reverse pick up terminal 28, which would provide an additional DC output to operate a magnetic stick track relay such as relay 20, remains unconnected.

It can thus be seen that the invention provides a new manner of utilizing existing railroad signalling equipment to provide improved versatility. Specifically, in applications where it is desirable to remove the line wire of the Phase-Selective Unit, this can be done effectively. Thus, costs attributable to the line wire and maintenance problems which it might entail are eliminated. However, the invention retails the capacity to convert to double-element phase-selective use with minor modification. Although certain preferred embodiments have been described herein, it is to be understood that various other embodiments and modifications can be made within the scope of the following claims.

I claim:

1. A single-element coded alternating current railway track circuit expandable to have double-element phase-selective capacity, said track circuit comprising:

a source means for providing alternating current energy;

a first transformer having a first primary winding and a first secondary winding, said first secondary winding electrically connected across a pair of rails at a first end of a railway block section;

a coding means electrically connected to said first primary winding and said source means for selectively providing a track signal from said source means to said first primary winding;

a series impedance electrically connected to said first primary winding and said source means;

a second transformer having a second primary winding and second and third secondary windings, said second primary winding electrically connected to receive said track signal from said rails at a second end of said block opposite said first end;

a phase reference transformer having a third primary winding and a fourth secondary winding, said fourth secondary winding connected in serial arrangement with said third secondary winding;

a first rectifier electrically connected across said second secondary winding;

a second rectifier connected across the serial combination of said third secondary winding and said fourth secondary winding; and a single rail direct current code-following relay having only two connected terminals which are electrically coupled to a rectified output of said first rectifier.

2. The single-element railway track circuit of claim 1 further comprising broken joint and overrun detectors connected across insulating joints between said railway block and adjacent blocks.

3. The single-element railway track circuit of claim 2 wherein said first and second rectifiers are full-wave bridge rectifiers.

4. The track circuit of claim 3 wherein said second transformer, said third transformer, said first rectifier, and said second rectifier are contained within a common housing having terminal means for providing said source means to said third primary winding.

* * * * *

UNITED STATES PATENT AND TRADEMARK OFFICE

CERTIFICATE OF CORRECTION

PATENT NO. : 5,219,426

DATED : June 15, 1993

INVENTOR(S) : ANTHONY G. EHRLICH

It is certified that error appears in the above-identified patent and that said Letters Patent is hereby corrected as shown below:

Column 6, line 31, claim 1, delete "rail" and insert --coil--.

Signed and Sealed this

Eighth Day of March, 1994

Bruce Lehman

*Attest:*

BRUCE LEHMAN

*Attesting Officer*

*Commissioner of Patents and Trademarks*